US008317879B2

(12) United States Patent
Sowle et al.

(10) Patent No.: US 8,317,879 B2
(45) Date of Patent: Nov. 27, 2012

(54) REDUCED SMOKING TEXTILE CARE DETERGENTS

(75) Inventors: Eddie D. Sowle, Woodbury, MN (US); Matthew A. Bilski, St. Paul, MN (US); Max M. Guzman, St. Paul, MN (US); Stephan M. Hubig, Maplewood, MN (US)

(73) Assignee: Ecolab USA Inc., St. Paul, MN (US)

( * ) Notice: Subject to any disclaimer, the term of this patent is extended or adjusted under 35 U.S.C. 154(b) by 22 days.

(21) Appl. No.: 13/023,001

(22) Filed: Feb. 8, 2011

(65) Prior Publication Data

US 2012/0030880 A1 Feb. 9, 2012

Related U.S. Application Data

(60) Provisional application No. 61/302,376, filed on Feb. 8, 2010.

(51) Int. Cl.

| | |
|---|---|
| ***B08B 3/04*** | (2006.01) |
| ***C11D 1/02*** | (2006.01) |
| ***C11D 1/72*** | (2006.01) |
| ***C11D 1/88*** | (2006.01) |
| ***C11D 3/43*** | (2006.01) |

(52) U.S. Cl. ..... 8/137; 510/276; 510/331; 510/340; 510/351; 510/356; 510/357; 510/360; 510/421; 510/426; 510/432; 510/492; 510/505; 510/535

(58) Field of Classification Search ..... 510/276, 510/331, 340, 351, 356, 357, 360, 421, 426, 510/432, 492, 505, 535; 8/137

See application file for complete search history.

(56) References Cited

U.S. PATENT DOCUMENTS 3,888,641 A 6/1975 Ito
4,199,483 A 4/1980 Kenneth
(Continued)

FOREIGN PATENT DOCUMENTS

WO WO98/04239 2/1998
(Continued)

OTHER PUBLICATIONS

Sasal North America Inc., Technical Data Sheet, "NOVEL II Alcohol Ethoxylates" Product Literature, pp. 1-2, Jan. 2003.*

(Continued)

*Primary Examiner* — Brian P Mruk
(74) *Attorney, Agent, or Firm* — Andrew D. Sorensen; Laura C. Dilorenzo

(57) ABSTRACT

The present invention provides compositions and methods to reduce smoking and/or haze during a heated laundry process. The compositions include a smoke reducing surfactant package and a detersive surfactant containing an amount of free alcohol. The smoke reducing surfactant package includes an anionic surfactant, an amphoteric surfactant or mixtures thereof. The surfactants are selected such that the amount of smoke or haze produced is reduced and or eliminated when garments contacted with the compositions containing the surfactants are heated to at least about 250° F. Methods of using the compositions are also provided.

19 Claims, 8 Drawing Sheets

U.S. PATENT DOCUMENTS

| | | | | |
|---|---|---|---|---|
| 4,210,764 | A | | 7/1980 | Yang et al. |
| 4,663,194 | A | | 5/1987 | Wixon |
| 5,118,650 | A | | 6/1992 | King |
| 5,266,233 | A | * | 11/1993 | Houghton et al. ..... 8/137 |
| 5,731,278 | A | | 3/1998 | Nair et al. |
| 2002/0107164 | A1 | | 8/2002 | Klaers et al. |
| 2004/0058839 | A1 | | 3/2004 | Tadrowski et al. |
| 2004/0092425 | A1 | | 5/2004 | Boutique et al. |
| 2005/0043200 | A1 | | 2/2005 | Barry et al. |
| 2006/0035807 | A1 | | 2/2006 | Kasturi et al. |
| 2006/0228323 | A1 | | 10/2006 | Novelle et al. |

FOREIGN PATENT DOCUMENTS

| | | |
|---|---|---|
| WO | WO00/58428 | 10/2000 |

OTHER PUBLICATIONS

Matheson, K. Lee, Cox, M.F., "Narrow Range Alcohol Ethoxylates", DAC Industrie Chimiche S.p.A., Milano, Vista Chemical Co., Houston (USA), Sep. 1995, p. 391-395.

Warry, D.L., Sones, E.L., McGuire, S.E., McCrimlisk, G., Lovas, J., "Reduction in Pluming During the Spray Drying of a Nonionic-Based Heavy Duty Powder", Vista Chemical Co. and Lever Brothers, Edgewater, NJ., Surfactants & Detergents Technical, JAOCS, vol. 63, No. 5 (May 1986), p. 691-695.

White, William E., Grieb, Ronald S., "Smoke From Long Chain Alcohols", ERDEC-TR-239, Edgewood Research, Development & Engineering Center, May 1995, 50 pages.

* cited by examiner

REDUCED SMOKING TEXTILE CARE DETERGENTS

CROSS REFERENCE TO RELATED APPLICATIONS

This application claims priority to Provisional Application Ser. No. 61/302,376, filed on Feb. 8, 2010, the entire disclosure of which is incorporated herein by reference in its entirety.

BACKGROUND OF THE INVENTION

Nonylphenol ethoxylates (NPEs) are predominantly used as industrial and domestic detergents and cleaning agents. Other uses have included degreasing products, dispersants, humidifying agents and stabilizers. They have also been used as additives in pesticides, in pharmaceuticals, personal care products, cosmetics, plastics and synthetic rubber production, oil additives, textiles, paint and varnishes, agricultural chemicals and in pulp and paper products.

However, while effective, NPEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods.

An alternative to NPEs are alcohol ethoxylates (AEs). These alternatives are less toxic and degrade more quickly in the environment. However, it has recently been found that textiles washed with NPE free and phosphorous free detergents containing AEs smoke when exposed to high heat, e.g., in a steam tunnel in industrial laundry processes, or when ironed. There is therefore a need for an NPE free, phosphorous free detergent that includes AEs, which has reduced and/or eliminated smoking when the treated article is exposed to high heat.

SUMMARY OF THE INVENTION

In some aspects, the present disclosure relates to detergent compositions comprising a smoke reducing surfactant package comprising an anionic surfactant, an amphoteric surfactant or mixtures thereof and a detersive surfactant comprising a nonionic surfactant having an amount of free alcohol. The detergent compositions have a mole ratio of about 1.4 to about 1 of the smoke reducing surfactant package to moles free alcohol, and the detergents are substantially free of phosphorous.

In some embodiments, the detergents comprise about 1 wt % to about 50 wt % of the anionic surfactant. In some embodiments, the anionic surfactant is selected from the group consisting of alkyl aryl sulfonates, ether sulfates, carboxylates, isethionates, silicone containing surfactants, secondary alkane sulfonates, alkyl methyl ester sulfonates, alpha olefin sulfonates, alkyl ether sulfates, alkyl sulfates, alcohol sulfates, and mixtures thereof. In other embodiments, the anionic surfactant comprises a linear alkyl benzene sulfonic acid or salts thereof. In some embodiments, the linear alkyl benzene sulfonic acid comprises linear dodecyl benzyl sulfonic acid, or salts thereof.

In some embodiments, the nonionic surfactant comprises an alcohol ethoxylate. In other embodiments, the alcohol ethoxylate comprises a $C_8$-$C_{18}$ alcohol with 1-15 moles of ethylene oxide. In still yet other embodiments, the nonionic surfactant comprises a narrow range alcohol ethoxylate comprising a $C_8$ to $C_{18}$ alcohol with 1-15 moles of ethylene oxide. In some embodiments, the detergents comprise about 5 wt % to about 85 wt % of the nonionic surfactant. In other embodiments, the detergents comprise about 0 wt % to about 20 wt % of the amphoteric surfactant.

In some embodiments, the amphoteric surfactant is selected from the group consisting of an amphodicarboxylic acid, a disodium cocoampho dipropionate, a disodium cocoampho diacetate, and mixtures thereof. In other embodiments, the detergent compositions further comprise a solvent. The solvent may be selected from the group consisting of water, glycerine, glycols, sorbitol, polypropylene glycol, polyacetates, diamines, aliphatic glycol ethers, aryl glycol ethers, aralkyl glycol ethers, aliphatic benzyl alcohol, isopropyl alcohol, esters, and mixtures thereof. The detergents may also comprise an optional ingredient selected from the group consisting of viscosity modifiers, fragrances, dyes, pigments, builders, threshold inhibitors for hard water precipitation, solidification aids, bleaches, bleach activators, antimicrobials, pH buffers, processing aids, active fluorescent whitening ingredient, an antifoam agent, and mixtures thereof.

In still yet other embodiments, the detergents comprise an additional surfactant. In some embodiments, the additional surfactant comprises a cationic quaternary ammonium compound. In other embodiments, the detergent is substantially free of nonyl phenol ethoxylate compounds.

In some aspects, the present disclosure relates to methods for reducing or eliminating the production of smoke from a surface of an article during a heated laundry process. The methods comprise washing the article with a detergent composition comprising a smoke reducing surfactant package comprising an anionic surfactant, an amphoteric surfactant or mixtures thereof and a detersive surfactant comprising a nonionic surfactant having an amount of free alcohol. The detergent composition has a mole ratio of about 1.4:1 of the smoke reducing surfactant package to moles free alcohol, the detergent is substantially free of phosphorous. The method further includes treating the article in a heated laundry process. In other embodiments, the article comprises a textile. In some embodiments, the textile comprises a material selected from the group consisting of polyester, cotton, and mixtures thereof. In still yet other embodiments, the textile comprises at least about 60% polyester.

In some embodiments, the heated laundry process comprises passing the article through a steam tunnel, ironing the article, or combinations thereof. In other embodiments, the temperature of the surface of the article is at least about 270° F. during the heated laundry process. In other embodiments, the detergents further comprise an optional ingredient selected from the group consisting of viscosity modifiers, fragrances, dyes, pigments, builders, threshold inhibitors for hard water precipitation, solidification aids, bleaches, bleach activators, antimicrobials, pH buffers, processing aids, active fluorescent whitening ingredient, an antifoaming agent and mixtures thereof. In still yet other embodiments, the detergents are substantially free of nonylphenol ethoxylate compounds.

In some embodiments, the article to be cleaned is an article in an industry selected from the group consisting of institutional hospitality, food service, and healthcare industries.

DETAILED DESCRIPTION OF THE INVENTION

Figure 1:
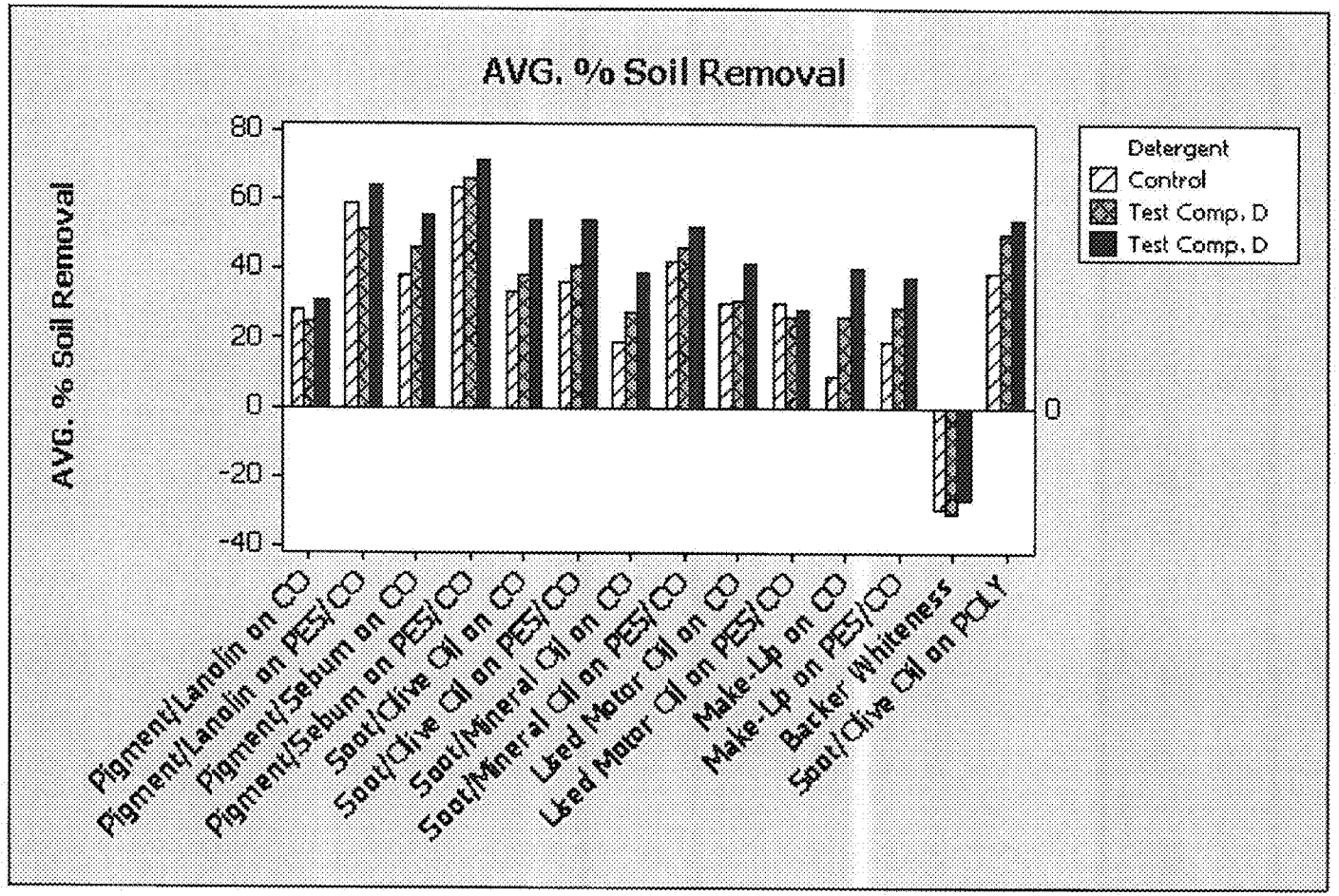
FIG. 1 is a graphical depiction of the average percent soil removal achieved on various soils and materials after treatment with embodiments of the invention, or a commercially available detergent.

In some aspects, the present disclosure relates to compositions capable of substantially reducing or eliminating the amount of free alcohols and/or low mole ethoximers deposited on to the surface of an article during a treatment process, e.g., washing process. The present disclosure also relates to methods of using the compositions. Without wishing to be bound by any particular theory, it is thought that by reducing or eliminating the amount of free alcohol and/or low mole ethoximer deposited on the surfaces of articles contacted with the compositions, the articles will have a reduced amount of smoking or hazing when they are exposed to high temperatures, e.g., in a heated laundry process, e.g., when they are passed through a steam tunnel or ironed in laundry process.

So that the invention maybe more readily understood, certain terms are first defined.

As used herein the terms "narrow range ethoxylated alcohol," "narrow range alcohol ethoxylate," or "peaked ethoxylate," refer to an alcohol ethoxylate that has a distribution curve that is narrower than the equivalent standard alcohol ethoxylate, and that has a substantially lower amount of unreacted alcohol. Narrow range alcohol ethoxylates are industrially produced, for example, by addition of ethylene oxide onto fatty alcohols in the presence of suitable catalysts (layer compounds which have been calcined or hydrophobized with fatty acids). This process can also be carried out on a variety of other hydrophobes and using different alkoxylating compounds (e.g., propylene oxide and butylene oxide) by modifying the catalyst properties.

As used herein, the term "phosphate-free" refers to a composition, mixture, or ingredient that does not contain a phosphate or phosphate-containing compound or to which a phosphate or phosphate-containing compound has not been added. Should a phosphate or phosphate-containing compound be present through contamination of a phosphate-free composition, mixture, or ingredients, the amount of phosphate shall be less than about 0.5 wt %. In an embodiment, the amount of phosphate is less than about 0.1 wt-%. In an embodiment, the amount of phosphate is less than about 0.01 wt %.

As used herein, the term "phosphorus-free" refers to a composition, mixture, or ingredient that does not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the amount of phosphorus shall be less than about 0.5 wt %. In an embodiment, the amount of phosphorus is less than about 0.1 wt-%. In an embodiment, the amount of phosphorus is less than about 0.01 wt %.

The reference to "cleaning" refers to at least one of the removal of soil, the removal of staining or the appearance of staining, and/or the reduction of a population of microbes. A cleaning process can include all three of the removal of soil, the removal of staining or the appearance of staining, and the reduction of a population of microbes. In other embodiments, a cleaning process can include any one of the removal of soil, the removal of staining or the appearance of staining, or the reduction of a population of microbes. In yet other embodiments, a cleaning process can include any combination of the removal of soil, the removal of staining or the appearance of staining, and the reduction of a population of microbes.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The compositions and methods can comprise, consist of, or consist essentially of the listed components or steps. As used herein, the term "consisting essentially of" shall be construed to mean including the listed ingredients and steps and such additional ingredients or steps which do not materially affect the basic and novel properties of the related compositions or methods, e.g., ability to reduce smoking and or hazing or the ability to remove soil.

Compositions

In some aspects the present invention is related to detergent compositions. In some embodiments, the compositions are free of, or substantially free of phosphorous or NPEs. The compositions can also be used as smoke reducing additives for use during any stage of the washing process, e.g., as a prerinse, during the washing phase, or during the rinse cycle. The compositions substantially reduce or eliminate the amount of a free alcohol and/or low mole ethoximer deposited on a surface of an article when the article is contacted with the composition, e.g., washed with the compositions. Additionally, it is thought that the compositions remove any previously deposited free alcohol and/or low mole ethoximers from the surfaces of articles. By reducing or removing the amount of free alcohols or low mole ethoximers deposited on the surface of the treated articles, it is thought that the contacted article will produce a reduced level of smoke or hazing when exposed to high temperatures, e.g., above about 250° F., for example, when passed through a steam tunnel or ironed in an industrial laundry process.

In some aspects, the compositions include a smoke reducing surfactant package (SRSP). The SRSPs include an anionic surfactant, an amphoteric surfactant or mixtures thereof. The SRSPs are capable of substantially reducing or eliminating the amount of free alcohol or low mole ethoximer deposited on the surface of an article contacted, e.g., washed or rinsed, with the SRSPs.

Detergent compositions including an SRSP provide an effective level of soil removal and/or stain reduction, while also reducing the amount of smoking or hazing produced when the treated article, e.g., textile, is exposed to high temperatures, e.g., at least about 250° F., for example, when the article is passed through a steam tunnel or ironed.

In some aspects, the detergent composition includes the SRSP and a detersive surfactant. Exemplary embodiments of detergent compositions including SRSPs are shown in the table below.

| Ingredient | | Exemplary Embodiment 1 Weight Percent (wt %) Range | Exemplary Embodiment 2 Weight Percent (wt %) Range | Exemplary Embodiment 3 Weight Percent (wt %) Range |
|---|---|---|---|---|
| SRSP | Anionic Surfactant | 0.1-75 | 5-25 | 10-20 |
| | Amphoteric Surfactant | 0-20 | 1-15 | 5-10 |
| Detersive Surfactant | | 5-80 | 20-50 | 30-40 |

The detersive surfactant includes a nonionic surfactant that has a smoke producing amount of residual free alcohol present. As used herein, the term "smoke producing amount of free alcohol" refers to an amount of free alcohol present in a detersive surfactant such that an article contacted with that surfactant will produce a visible smoke or haze upon being heated, e.g., heated to above about 250° F.

Smoke Reducing Surfactant Packages

Anionic Surfactants

In some aspects, the SRSPs include at least one anionic surfactant. The SRSPs can include 1, 2, 3, or more anionic surfactants. In some embodiments, the anionic surfactant includes, but is not limited to a fatty acid. Fatty acids for use in the compositions of the invention include saturated fatty acids, unsaturated fatty acids, and mixtures thereof. Exemplary saturated fatty acids include, but are not limited to, caproic acid, caprylic acid, capric acid, lauric acid, myristic acid, palmitic acid, stearic acid, arachidic acid, and mixtures thereof. Exemplary unsaturated fatty acids include, but are not limited to, palmitoleic acid, oleic acid, linoleic acid, linolenic acid, ricinoleic acid, and mixtures thereof. Additional fatty acids for use in the detergents SRSPs include, but are not limited to, saturated and/or unsaturated fatty acids obtained from natural sources such as plant or animal esters (e.g., palm kernel oil, palm oil, coconut oil, babassu oil, safflower oil, tall oil, castor oil, tallow and fish oils, grease, and mixtures thereof) or synthetically prepared (e.g., via the oxidation of petroleum or by hydrogenation of carbon monooxide via the Fisher-Tropsch process). In some embodiments, the anionic surfactant includes a coconut fatty acid.

Other exemplary anionic surfactants that can be included in the SRSPs include carboxylates, isethionates, silicone containing surfactants, and mixtures thereof. In some embodiments, the anionic surfactant includes sulfonates, sulfates, and mixtures thereof. Suitable sulfates and sulfonates include, but are not limited to, alkyl aryl sulfonates, secondary alkane sulfonates, alkyl methyl ester sulfonates, alpha olefin sulfonates, alkyl ether sulfates, alkyl sulfates, alcohol sulfates, and mixtures thereof.

Exemplary alkyl aryl sulfonates that can be used can have an alkyl group that contains 6 to 24 carbon atoms and the aryl group can be at least one of benzene, toluene, and xylene. An exemplary alkyl aryl sulfonate includes linear alkyl benzene sulfonate. An exemplary linear alkyl benzene sulfonate includes linear dodecyl benzyl sulfonate that can be provided as an acid that is neutralized to form the sulfonate. Additional exemplary alkyl aryl sulfonates include xylene sulfonate and cumene sulfonate. Exemplary alkane sulfonates that can be used in the cleaning composition can have an alkane group having 6 to 24 carbon atoms. Exemplary alkane sulfonates that can be used include secondary alkane sulfonates. An exemplary secondary alkane sulfonate includes sodium $C_{14}$-$C_{17}$ secondary alkyl sulfonate commercially available as Hostapur SAS from Clariant. Exemplary alkyl methyl ester sulfonates that can be used in the cleaning composition include those having an alkyl group containing 6 to 24 carbon atoms. Exemplary alpha olefin sulfonates that can be used in the cleaning composition include those having alpha olefin groups containing 6 to 24 carbon atoms.

Exemplary alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. An exemplary alkoxy group is ethoxy. An exemplary alkyl ether sulfate is sodium lauric ether ethoxylate sulfate and is available under the name Steol® CS-460 (commercially available from Stepan Company). Exemplary alkyl sulfates that can be used in the cleaning composition include those having an alkyl group containing 6 to 24 carbon atoms. Exemplary alkyl sulfates include sodium lauryl sulfate and sodium lauryl/myristyl sulfate. Exemplary alcohol sulfates that can be used in the cleaning composition include those having an alcohol group containing about 6 to about 24 carbon atoms.

In some embodiments, the anionic surfactant includes an alkyl aryl sulfonate, an ether sulfate, a carboxylate, an isethionate, a silicone containing surfactant, a secondary alkane sulfonate, an alkyl methyl ester sulfonate, an alpha olefin sulfonate, an alkyl ether sulfate, an alkyl sulfate, an alcohol sulfate, and mixtures thereof. In some embodiments, the compositions include a fatty acid and an alkyl aryl sulfonic acid as anionic surfactants.

In some embodiments, the SRSPs can include about 0.1 wt % to about 75 wt % of the anionic surfactant. In other embodiments, the SRSPs include about 1 wt % to about 20 wt %, about 5 wt % to about 30 wt % or about 15 to about 25 wt % of the anionic surfactant. It is to be understood that all ranges and values between these ranges and values are encompassed by the present invention.

In other embodiments, the SRSPs are used as smoke reducing additives for use in a laundry process that are formulated separately from a detergent. When used as a smoke reducing additives that are not part of a detergent composition, the SRSPs can include about 100 wt % of an anionic surfactant. In some embodiments, the SRSPs include an alkyl aryl sulfonic acid or salt thereof as the anionic surfactant.

Amphoteric Surfactant

In some embodiments, the SRSPs include an amphoteric surfactant. Amphoteric surfactants that are anionic at an alkaline pH can be included in the SRSPs. Exemplary amphoteric surfactants for use in the present invention include those derived from coconut products such as coconut oil or coconut fatty acid. In some embodiments, the coconut derived surfactants include as part of their structure an ethylenediamine moiety, an alkanolamide moiety, an amino acid moiety, preferably glycine, or a combination thereof; and an aliphatic substituent of from about 8 to 18 (preferably 12) carbon atoms. Such a surfactant can also be considered an alkyl amphodicarboxylic acid. Suitable amphoteric surfactants include, but are not limited to, disodium cocoampho dipropionate, which is commercially available under the tradename Miranol® FBS, and disodium cocoampho diacetate, which is commercially available under the tradename Miranol® C2M SF Conc. from Rhodia Inc., Cranbury N.J. In some embodiments, the amphoteric surfactant includes cocoamidopropyl hydroxysultaines, $C_8$ amphpocarboxylates, capril imidazoline dicarboxylates, sodium carboxyethyl cocophosphoethyl imadazoline, and octyl dipropionates. Commercially available examples of these materials are Amphoterge® KJ2 by Lonza, Crosultaine® C-50 by Croda, Rhodapon® JEM by Rhodia, Phosphoteric® TC-6 by Uniquema, and Deteric® ODP-LF by DeForest.

In some embodiments, the amphoteric surfactant includes a coconut derived surfactant. The coconut derived surfactant can include at least one of an ethylenediamine moiety, an alkanolamide moiety, an amino acid moiety, and combinations thereof; and an aliphatic substituent of from about 8 to 18 carbon atoms. In other embodiments, the coconut derived surfactant includes an amide mixture of coconut fatty acids. The amphoteric surfactant can include a cocoamine oxide surfactant, for example, Barlox® 12, a commercially available cocoamine oxide surfactant.

The compositions of the present invention can include about 0 wt % to about 20 wt % of the amphoteric surfactant. In other embodiments, the compositions include about 5 wt % to about 15 wt % of the amphoteric surfactant. It is to be understood that all values and ranges between these values and ranges are included in the present invention.

Detersive Surfactants

In some embodiments, the detergent compositions include a detersive surfactant. Detersive surfactants suitable for use include nonionic surfactants. The nonionic surfactants included contain a smoke producing amount of residual free alcohol. In some embodiments, the amount of residual free alcohol is between about 0.1% to about 20%, between about 1.5% to about 15%, or between about 3% to about 13%. It is to be understood that all values and ranges between these value and ranges are encompassed in the present disclosure.

Exemplary nonionic surfactants for use in the compositions include, but are not limited to alcohol alkoxylates. Alcohol alkoxylates are generally prepared by alkoxylating the aliphatic alcohol with the oxyalkylene in the presence of a catalyst such as potassium oxide or sodium oxide. Examples of alcohol ethoxylates and alcohol propoxylates useful as nonionic surfactants include $C_8$-$C_{18}$ alcohols with 1-15 moles of ethylene oxide (EO) or propylene oxide (PO) units per mole of alcohol. The distribution of ethoxylation or propoxylation, as the case may be, is quite broad and a sizable amount of free alcohol is left in the product. Common conventional alcohol ethoxylates are listed under the chemical classification of "ethoxylated alcohols" in McCutcheon's Emulsifiers & Detergents, Annual 1992. Common conventional alcohol propoxylates as well as propoxylated and ethoxylated alcohols are listed under the chemical classification "propoxylated & ethoxylated fatty acids, alcohol or alkyl phenols" in McCutcheon's. The relevant portions of McCutcheon's are incorporated herein by reference.

In some embodiments, the compositions include an alcohol ethoxylate. Alcohol ethoxylates suitable for use in the present invention include, but are not limited to, $C_8$-$C_{18}$ alcohol with 1-15 moles of ethylene oxide. Exemplary alcohol ethoxylates include, but are not limited to: surfactant sold under the tradename Berol® 048, Berol® 050, Berol® 175, Berol® 185 from Akzo Nobel; surfactants sold under the tradename Neodol® available from Shell Chemical Co.; surfactants sold under the tradename Genapol® (e.g., Genapol B2) commercially available from Hoeschet AG; and surfactants sold under the tradename Surfonic® (e.g., Surfonic® L24-7 which is a seven-mole ethoxylate of linear, primary 12-14 carbon number alcohol, and Surfonic® L24-3 which is a three mole ethoxylate of linear, primary 12-14 carbon number alcohol).

In some embodiments, a branched alcohol alkoxylate can be included in the compositions. Exemplary branched alcohol alkoxylates include, but are not limited to, those available under the name Lutensol® XP30, Lutensol® XP-50, and Lutensol® XP-80 available from BASF Corporation. In general, Lutensol® XP-30 can be considered to have 3 repeating ethoxy groups, Lutensol® XP-50 can be considered to have 5 repeating ethoxy groups, and Lutensol® XP-80 can be considered to have 8 repeating ethoxy groups.

In other embodiments, the nonionic surfactant includes narrow range or "peaked" alcohol alkoxylates. Peaked alkoxylates have a narrower and highly peaked alkoxylation distribution that results in a lower amount of residual free alcohol, a lower amount of lower oxyalkylene adducts and a lower amount of higher oxyalkylene adducts in the product. Peaked alcohol alkoxylates are obtained through the use of different catalysts and/or manufacturing conditions. Examples of the preparation of peaked alcohol ethoxylates include U.S. Pat. No. 4,210,764 to Yang et al. and U.S. Pat. No. 5,118,650 to King, the disclosures of which are incorporated herein by reference.

In some embodiments, the peaked alcohol alkoxylates for use in the present invention include alcohol alkoxylates having a residual free alcohol content of less than about three percent. Exemplary peaked alcohol alkoxylates are $C_6$-$C_{20}$ alcohol ethoxylates, $C_6$-$C_{20}$ alcohol propoxylates, $C_6$-$C_{20}$ propoxylated and ethoxylated alcohols and combinations thereof. Other exemplary peaked alcohol alkoxylates are $C_8$-$C_{18}$ alcohol ethoxylates containing from about 1 to about 20 moles of ethylene oxide (EO) per molecule, $C_8$-$C_{18}$ alcohol propoxylates containing from about 1 to about 20 moles of propylene oxide (PO) per molecule, and $C_8$-$C_{18}$ propoxylated and ethoxylated alcohols.

In some embodiments, the narrow range alcohol ethoxylate includes a $C_8$ to $C_{18}$ alcohol with 1-15 moles of ethylene oxide. Exemplary narrow range alcohol ethoxylates suitable for use in the compositions include, but are not limited to, NOVEL II® Alcohol Ethoxylates commercially available from Sasol North America, and Berol® 260, 266 and 840 surfactants, commercially available from AkzoNobel.

In some embodiments, the compositions of the present invention include about 5 wt % to about 80 wt % of the nonionic surfactant. In other embodiments, the compositions include about 30 wt % to about 60 wt %, or about 40 wt % to about 50 wt % of the nonionic surfactant. It is to be understood that all values and ranges between these values and ranges are included in the present invention.

In some embodiments, the mole ratio of anionic surfactant (present in the SRSPs) to moles free alcohol is greater than about 1.4. Without wishing to be bound by any particular theory, it is thought that at a lower mole ratio of anionic surfactant to free alcohol, the anionic surfactant is not present at an amount effective to reduce or eliminate smoking or hazing. In some embodiments, the mole ratio of anionic surfactant to free alcohol is greater than about 4, or greater than about 10.

Additional Ingredients

The compositions of the present invention can further include additional ingredients. Additional ingredients suitable for use in the compositions include, but are not limited to, solvents, viscosity modifiers, fragrances, dyes, pigments, builders, threshold inhibitors for hard water precipitation, solidification aids, bleaches, bleach activators, antimicrobials, pH buffers, processing aids, active fluorescent whitening ingredient, additional surfactants, antifoaming agents and mixtures thereof. The compositions of the present invention can also exclude any of the above additional ingredients.

Solvents

In some embodiments, the compositions further include a solvent. Solvents suitable for use in the present invention include, but are not limited to, glycerine, glycols, sorbitol, polypropylene glycol, polyacetates, diamines, aliphatic glycol ethers, aryl glycol ethers, aralkyl glycol ethers, aliphatic benzyl alcohol, isopropyl alcohol, esters, and mixtures thereof. In some embodiments, the glycol includes propylene glycol, ethylene glycol, hexylene glycol, and mixtures thereof. In some embodiments, the solvent includes water. The water can include water from any source including deionized water, tap water, softened water, and combinations thereof.

Additional Surfactant

In some embodiments, the compositions include an additional surfactant. Suitable additional surfactants include cationic surfactants. Exemplary cationic surfactants for use in the compositions of the invention include quaternary ammonium compounds such as alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof.

Exemplary alkylated quaternary ammonium compounds include ammonium compounds having an alkyl group containing between 6 and 24 carbon atoms. Exemplary alkylated quaternary ammonium compounds include monoalkyl trimethyl quaternary ammonium compounds, monomethyl trialkyl quaternary ammonium compounds, and dialkyl dimethyl quaternary ammonium compounds. Examples of the alkylated quaternary ammonium compounds are available commercially under the names Adogen™, Arosurf®, Variquat®, and Varisoft®. The alkyl group can be a $C_8$-$C_{22}$ group or a $C_8$-$C_{18}$ group or a $C_{12}$-$C_{22}$ group that is aliphatic and saturated or unsaturated or straight or branched, an alkyl group, a benzyl group, an alkyl ether propyl group, hydrogenated-tallow group, coco group, stearyl group, palmityl group, and soya group. Exemplary ring or cyclic quaternary ammonium compounds include imidazolinium quaternary ammonium compounds and are available under the name Varisoft®. Exemplary imidazolinium quaternary ammonium compounds include methyl-1hydr. tallow amido ethyl-2-hydr. tallow imidazolinium-methyl sulfate, methyl-1-tallow amido ethyl-2-tallow imidazolinium-methyl sulfate, methyl-1-oleyl amido ethyl-2-oleyl imidazolinium-methyl sulfate, and 1-ethylene bis(2-tallow, 1-methyl, imidazolinium-methyl sulfate). Exemplary aromatic quaternary ammonium compounds include those compounds that have at least one benzene ring in the structure. Exemplary aromatic quaternary ammonium compounds include dimethyl alkyl benzyl quaternary ammonium compounds, monomethyl dialkyl benzyl quaternary ammonium compounds, trimethyl benzyl quaternary ammonium compounds, and trialkyl benzyl quaternary ammonium compounds. The alkyl group can contain between about 6 and about 24 carbon atoms, and can contain between about 10 and about 18 carbon atoms, and can be a stearyl group or a hydrogenated tallow group. Exemplary aromatic quaternary ammonium compounds are available under the names Variquat® and Varisoft®. The aromatic quaternary ammonium compounds can include multiple benzyl groups. Diquaternary ammonium compounds include those compounds that have at least two quaternary ammonium groups. An exemplary diquaternary ammonium compound is N-tallow pentamethyl propane diammonium dichloride and is available under the name Adogen 477. Exemplary alkoxylated quaternary ammonium compounds include methyl-dialkoxy alkyl quaternary ammonium compounds, trialkoxy alkyl quaternary ammonium compounds, trialkoxy methyl quaternary ammonium compounds, dimethyl alkoxy alkyl quaternary ammonium compounds, and trimethyl alkoxy quaternary ammonium compounds. The alkyl group can contain between about 6 and about 24 carbon atoms and the alkoxy groups can contain between about 1 and about 50 alkoxy groups units wherein each alkoxy unit contains between about 2 and about 3 carbon atoms. Exemplary alkoxylated quaternary ammonium compounds are available under the names Variquat®, Varstat®, and Variquat®. Exemplary amidoamine quaternary ammonium compounds include diamidoamine quaternary ammonium compounds. Exemplary diamidoamine quaternary ammonium compounds are available under the name Varisoft®. Exemplary amidoamine quaternary ammonium compounds that can be used according to the invention are methyl-bis(tallow amidoethyl)-2-hydroxyethyl ammonium methyl sulfate, methyl bis (oleylamidoethyl)-2-hydroxyethyl ammonium methyl sulfate, and methyl bis (hydr.tallowamidoethyl)-2-hydroxyethyl ammonium methyl sulfate. Exemplary ester quaternary compounds are available under the name Stephantex™.

The quaternary ammonium compounds can include any counter ion that allows the component to be used in a manner that imparts fabric-softening properties. Exemplary counter ions include chloride, methyl sulfate, ethyl sulfate, and sulfate.

Optical Brightener

In some embodiments, an optical brightener component, may be present in the compositions. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal® UNPA, which is commercially available through the Ciba Geigy Corporation located in Switzerland.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. In some embodiments, the optical brightener is a chlorine stable optical brightener.

In some embodiments, the optical brightener is present at about 0.1 wt % to about 1.0 wt % in the present invention.

Methods of Use

In some aspects, the present disclosure relates to methods for reducing or eliminating the production of smoke from a surface of an article during a heated laundry process, for example, when the article is passed through a steam tunnel in a laundry process, or when the article is ironed. The methods include contacting an article with a detergent composition including an SRSP and a detersive surfactant during a laundry process, e.g., a wash process. After being contacted with the detergent composition, the article can then be exposed to high temperatures, e.g., greater than about 250° F., during a heated laundry process with a reduced or eliminated amount of smoking and/or hazing.

The step of contacting can occur at any time during the laundry process. In some embodiments, the SRSPs are included in a detergent composition with a detersive surfactant. The detergent composition then contacts the article during a wash process. In other embodiments an SRSP is formulated separately from a detergent and is used a prerinse, or a final rinse during a washing process. After being contacted with the SRSP, the article can then be exposed to high temperatures, e.g., greater than about 250° F., during a heated laundry process with a reduced or eliminated amount of smoking and/or hazing. In some embodiments, the surface of the article during the heated laundry process is between about 250° F. and about 300° F., between about 260° F. and about 290° F., or greater than about 270° F.

The compositions can be used on a variety of articles. In some embodiments, the article to be cleaned is an article in the industrial industry, institutional industry, hospitality industry, food service industry, specialty industry, healthcare industry and combinations thereof. In some embodiments, the article includes a textile (e.g., a fabric). Textiles suitable for use with the compositions and methods of the present invention include, but are not limited to, towels, sheets, pillow cases, uniforms (e.g., shirts, pants, and jackets), dress shirts, and lab coats.

Textiles to be treated in accordance with the present invention can include a variety of materials, for example, cotton (CO), polyester (PES), linen, and combinations thereof. In some embodiments, the textile to be treated includes at least about 60% polyester, or at least about 100% polyester. Textiles to be treated can also include cotton/polyester blends, e.g., about 35% cotton and about 65% polyester.

In some embodiments, the compositions reduce or eliminate smoking or hazing when an article treated, e.g., washed, rinsed or soaked, with the compositions is then passed through a steam tunnel in an industrial laundry process. Fabrics being processed through a steam tunnel are typically subjected to steam for a period of time ranging from about 30 seconds to about 1 minute at temperatures of from about 250° F. to about 290° F. Articles are passed through the steam tunnel after they have been washed in order to remove wrinkles In some embodiments, the temperature of the surface of the article in the steam tunnel is at least about 250° F., at least about 260°, or at least about 270° F.

In some embodiments, the compositions of the invention reduce or eliminate smoking or hazing when the treated article is ironed. In some embodiments, the temperature of the surface of the article when it is ironed is at least about 250° F., at least about 260° F., at least about 270° F., or between about 250° F. and about 300° F., or between about 260° F. and about 290° F.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Example 1

A test was run to determine whether a detergent composition according to embodiments of the present disclosure would reduce or eliminate smoke or haze at an industrial laundry processing facility. A detergent composition according to embodiments of the present invention was prepared. The composition ("Composition A") included: 40% of a nonionic surfactant, 31% of a combination of anionic surfactants including a fatty acid and a linear alkyl benzene sulfonic acid, and 8% of an amphoteric surfactant. Composition A further included a solvent, a whitening agent, and a source of alkalinity.

Composition A was compared to a conventional detergent composition ("Comparative Composition 1"). Comparative Composition 1 included 3.7 wt % of a nonionic surfactant, 3 wt % of an anionic surfactant including a fatty acid, and 20 wt % ethylenediaminetetraacetic acid. Comparative Composition 1 also included a solvent, a source of alkalinity, an anti-foaming agent and a dye.

All garments to be observed were washed with either Composition A or Comparative Composition 1. The garments tested included tablecloths, smocks, shop towels, bar towels, and FR garments. After washing, the garments were passed through a steam tunnel and observed for smoking and/or hazing. The temperature in the steam tunnel was set to achieve a surface temperature of the garment of 280° F. The results are shown below:

TABLE 1

| Composition Used During Washing | Garment | Observations |
|---|---|---|
| Composition A | Tablecloths | Virtually no smoke or hazing |
| Composition A | Smocks | Virtually no smoke or hazing |
| Comparative Composition 1 | Smocks | Significant amount of smoking |

Overall, it was observed that the compositions of the inventions immediately (e.g., after the first wash) decreased the amount of smoke formed in the steam tunnel. In some cases, the smoke was almost entirely eliminated.

Example 2

A test was performed to evaluate whether the free alcohol in a wash solution is absorbed by polyester upon immersion. For this test, a single polyester swatch was immersed in a test solution of a commercially available detergent, Turbo-Flex D-AE (commercially available from Ecolab Inc.) known to contain an amount of free alcohol. The detergent was used at a dilution of 1.36 mL/L. Each swatch was immersed in this same test solution four times. A comparative test was run using a cotton swatch. Each swatch was allowed to completely gas/steam off before re-immersion.

A hot plate was set to 300° F. The test solution was poured into a large watch glass. The swatch was then immersed into the watch glass completely. The swatch was allowed to soak in the solution for 5 to 10 seconds to become completely saturated with solution. The swatch was then removed from the watch glass, and the excess solution was allowed to drip off. The swatch was then immediately placed completely on the hot plate. A black background was placed behind the hot plate to allow for proper viewing of any resulting steam/smoke from the swatch. The swatches were observed, and any steam/smoke produced was recorded. This test was re-run four times in total for each swatch. A fresh test solution was used for each replicate. A soft water control was also tested.

The results from this test are shown in the table below.

TABLE 2

| Test Run | Cotton Swatch | Polyester Swatch |
|---|---|---|
| 1 | Light, wispy steam | Light steam break, then long lasting white smoke |
| 2 | Light, wispy steam | Light steam, break, white smoke, shorter |
| 3 | Light, wispy steam | Light steam, break, almost no smoke, quick |
| 4 | Light, wispy steam | Light steam, no smoke |

As can be seen from this table, the cotton showed no smoke production, while the polyester initially showed heavy smoke production. After multiple immersions, the smoke became less prominent. Without wishing to be bound by any particular theory, it is thought that the decrease in smoking in the polyester swatch over time shows that the polyester is preferentially absorbing the free alcohol in solution. It is the free alcohol in solution which is thought to be creating the smoke/haze at high temperatures. This test also demonstrates that polyester fabrics show a greater affinity for free alcohols than cotton fabrics.

As a follow up, a watch glass was filled with water, and C12-C14 alcohol was added, drop wise, into the water. This alcohol remained beaded on the surface of the water. Upon immersion of a polyester swatch, the alcohol bead was visually observed to be absorbed by the polyester swatch. Although tested with a C12 to C14 alcohol, it is thought that any free alcohol will demonstrate this behavior.

Example 3

A test was run at a laundry processing facility to evaluate possible solutions to smoking and hazing that was observed when fabrics were heated above about 270° F. during processing, for example, in a steam tunnel, or when ironed, after being washed using TurboFlex D-AE, a commercially available detergent composition (available from Ecolab Inc.) that is NPE free, but contains free alcohol (Comparative Composition 1). For this test, one detergent composition in accordance with embodiments of the present disclosure (Test Composition B) and one additive (Test Composition C) were tested. Test Composition B included the following ingredients:

TABLE 3

| Test Composition B | |
|---|---|
| Ingredient | Weight Percent (wt %) |
| Anionic Surfactant | 31.2 |
| Nonionic Surfactant | 40 |
| Amphoteric Surfactant | 8.8 |
| Solvent | 19.7 |
| Optical Brightener | 0.3 |

The anionic surfactant included a mixture of two anionic surfactants, a coconut fatty acid, and an alkyl aryl sulfonate. The nonionic surfactant was an alcohol ethoxylate nonionic surfactant, and the amphoteric surfactant was an amine oxide surfactant.

Test Composition C was a water conditioning composition that was phosphorous free. Test Composition C included water, a source of alkalinity, polyacrylic acid, and polyacrylic/polymaleic acid. Test Composition B was used to completely replace the detergent that was currently in use at the facility, and Test Composition C was used as an additive. For this test, Test Composition C was hand-dosed into the washer during the wash step at a rate of 10 oz/cwt.

The first test was run on tablecloths that were previously observed to exhibit smoking and hazing in the plant. After washing the tablecloths with either Test Composition B or C, as described above, the tablecloths were hand fed into a roller ironer, where smoke was previously observed. In order to document the smoking and hazing, video cameras were used. A tripod was set up with a digital camera, and the floor was marked with its location to ensure a consistent image for all videos. A black backdrop was held up on the other side of the ironer, and the camera was zoomed and focused on the backdrop. Control videos of two tablecloths that had been washed with 3 oz/cwt of Comparative Composition 1 were also taken.

Test Composition B was also dosed at 3 oz/cwt, and was used to wash a load of tablecloths. The tablecloths were then run through the ironer, and a video taken. The tablecloths washed with Test Composition B had a greatly reduced (almost none) amount of smoke and haze compared to the tablecloths washed with Comparative Composition 1 when both groups were passed through the ironer.

A test was also run on butchers' coats. For this test, the garments were washed on day one with either Comparative Composition 1, or Test Composition B or C. On the second day the garments were run through the steam tunnel. For this test, Comparative Composition 1 was dosed at 5 oz/cwt, and Comparative Composition C was dosed at 10 oz/cwt. Comparative Composition B was dosed at 5 oz/cwt. After the wash cycle, the garments were placed in baskets and sat overnight. The next morning, the garments were run through the steam tunnel. Temperature test strips were run through the tunnel to verify that the temperature was greater than about 270° F. Videos were taken of the amount of smoking and hazing present in the steam tunnel.

It was observed that Test Composition B had an immediate and drastic effect on the garments. Almost no smoke and haze was generated in the steam tunnel. The garments treated with Test Composition C used as an additive had a reduced amount of smoke and haze compared to the garments treated with Comparative Composition 1. However, the results seen were not as great as those found with Test Composition B.

Overall, it was found that Test Composition B was very effective at reducing/eliminating the smoking and hazing issue in steam tunnels. Without wishing to be bound by any particular theory, it is thought that not only did Test Composition B prevent the build up of free alcohol on the polyester garments, but it is thought that the large reduction in visible smoke and haze indicated that Test Composition B also stripped the previously deposited free alcohol away from the polyester linen.

Example 4

A test was run in an industrial laundry processing plant to determine the effectiveness of a test detergent to reduce smoking and/or hazing when finishing textiles, while not sacrificing cleaning performance. For this test, a commercially available detergent, Turboflex D-AE, commercially available from Ecolab, was used as a control. A test composition according to embodiments of the invention, Test Composition D, was also tested. Test Composition D included the following:

TABLE 4

| Ingredient | Weight Percent (wt %) |
|---|---|
| Anionic Surfactant | 14.0 |
| Nonionic Surfactant | 30.0 |
| Amphoteric Surfactant | 6.0 |
| Solvent | 49.75 |
| Optical Brightener | 0.15 |
| Anti-foaming agent | 0.1 |

The anionic surfactant used included a linear alkyl benzene sulfonic acid, the nonionic surfactant included an alcohol ethoxylate, and the amphoteric surfactant included an amine oxide.

For this test, industrial shirts, butcher coats/pants, and fire resistant garments were used as the test fabrics. On day one of the test, baseline data was collected for the current Turboflex D-AE detergent for all test variables. The test variables included: cleaning performance; visual observation of smoke and haze; evaluation of garment whiteness on white aprons, white sheets, bar mops, and pants; a sink test with finished shop towels; and the current state of the shaker screen was evaluated. The table below describes the test variable, and the methods of analysis.

TABLE 5

| Variable | Method of Analysis |
|---|---|
| Cleaning/ Soil Removal | Colorimetric analysis of standard soils/stains to calculate a percent soil removal. |

TABLE 5-continued

| Variable | Method of Analysis |
|---|---|
| Visible smoke/haze | Visual observations of smoke/haze as well as video of both the irons and the steam tunnel. |
| Garment Whiteness | Whiteness was evaluated on white garments and bar mops with a whiteness meter and compared to the control. Possible hold of white garments pre and post washing for comparison, as well as measurement with and without UV. |
| Sink/Wick-up Test | Rolled up shop towels are dropped into water and the time taken for the towel to sink is recorded |
| Waste water processing and cost | Was evaluated by an onsite wastewater team. |
| Blinding of shaker screens | Visual evaluation of shaker screens. Was there an increase in the cleaning frequency of shaker screens? |

After gathering the baseline data, the plant was switched to using Test Composition D as a detergent. Data for the above test variables using Test Composition D was then collected.

Soil Removal

Figure 2:
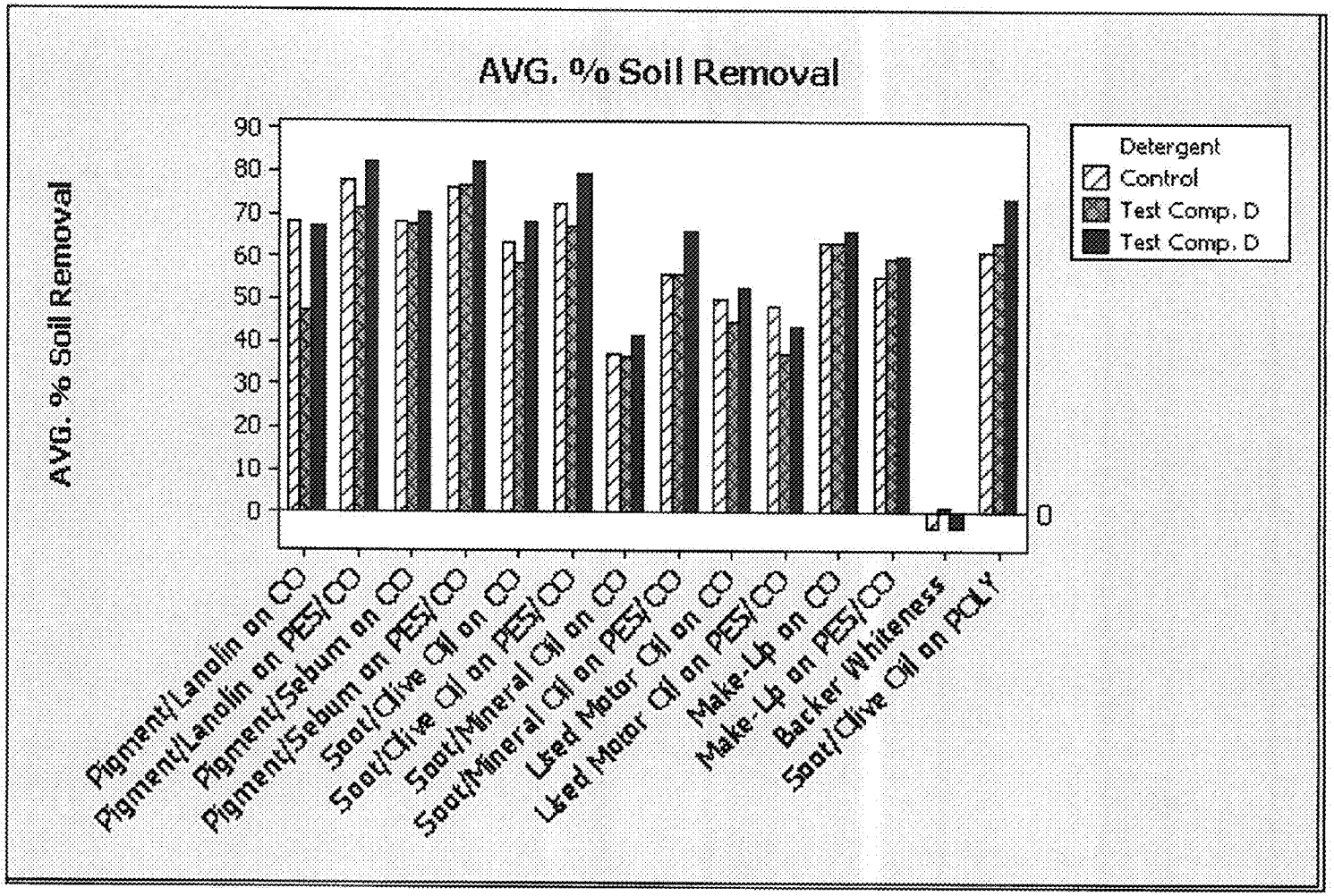
FIG. 2 is a graphical depiction of the average percent soil removal achieved on various soils and materials after treatment with embodiments of the invention, or a commercially available detergent.

FIGS. 1 and 2 show the results of the soil removal comparison test. As can be seen from these figures, on all soils, there was performance parity or an increase in soil removal when Test Composition D was used compared to the control detergent formulation.

It was also noted that the cleaning improved over time when using Test Composition D. Without wishing to be bound by any particular theory, it is thought that this was due to Test Composition D actually stripping re-deposited soils from the textiles with increased washes.

Whiteness Data

Figure 3:
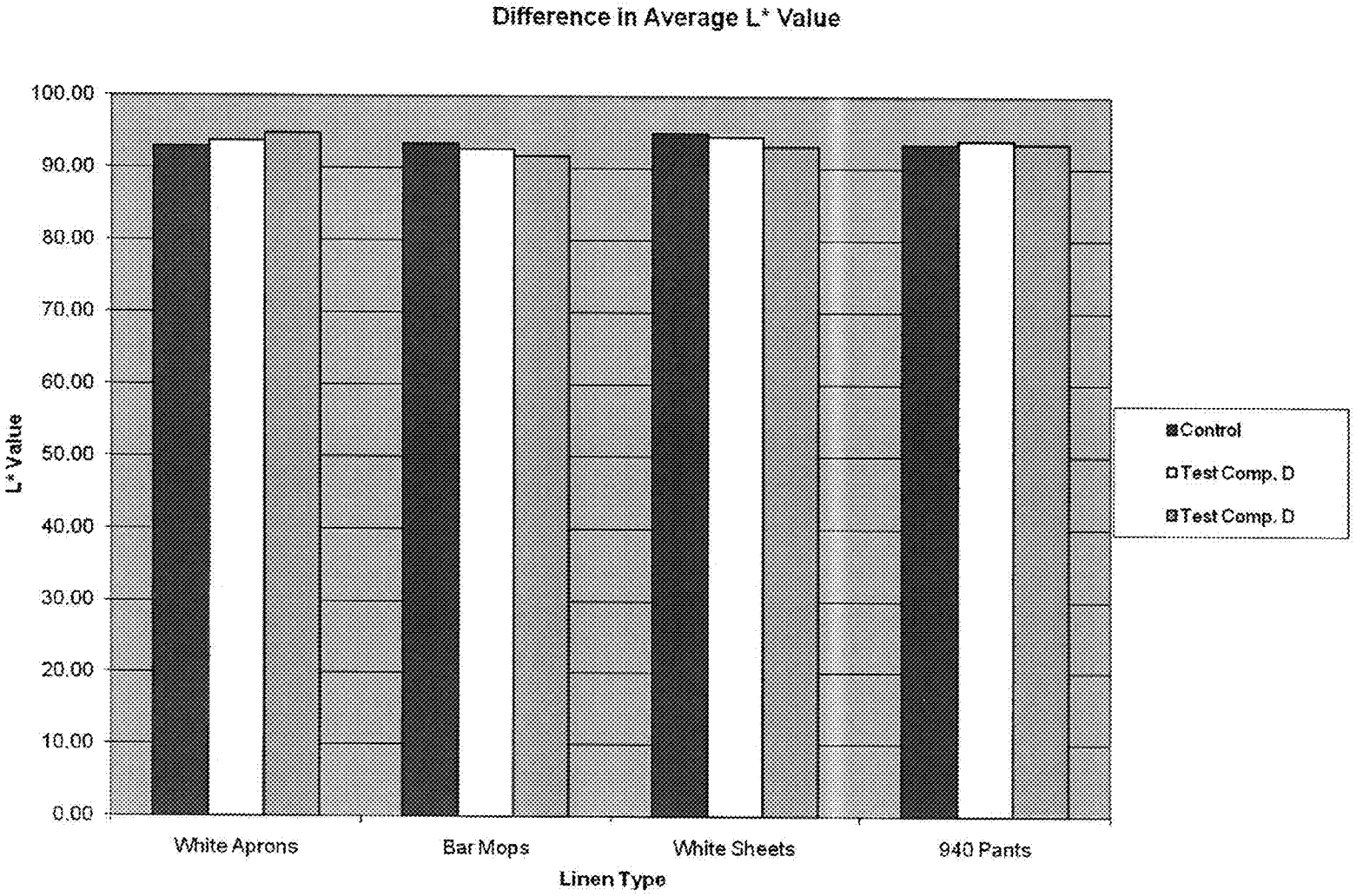
FIG. 3 is a graphical depiction of the average L value of various linen types after treatment with embodiments of the invention, or a commercially available detergent.
Figure 4:
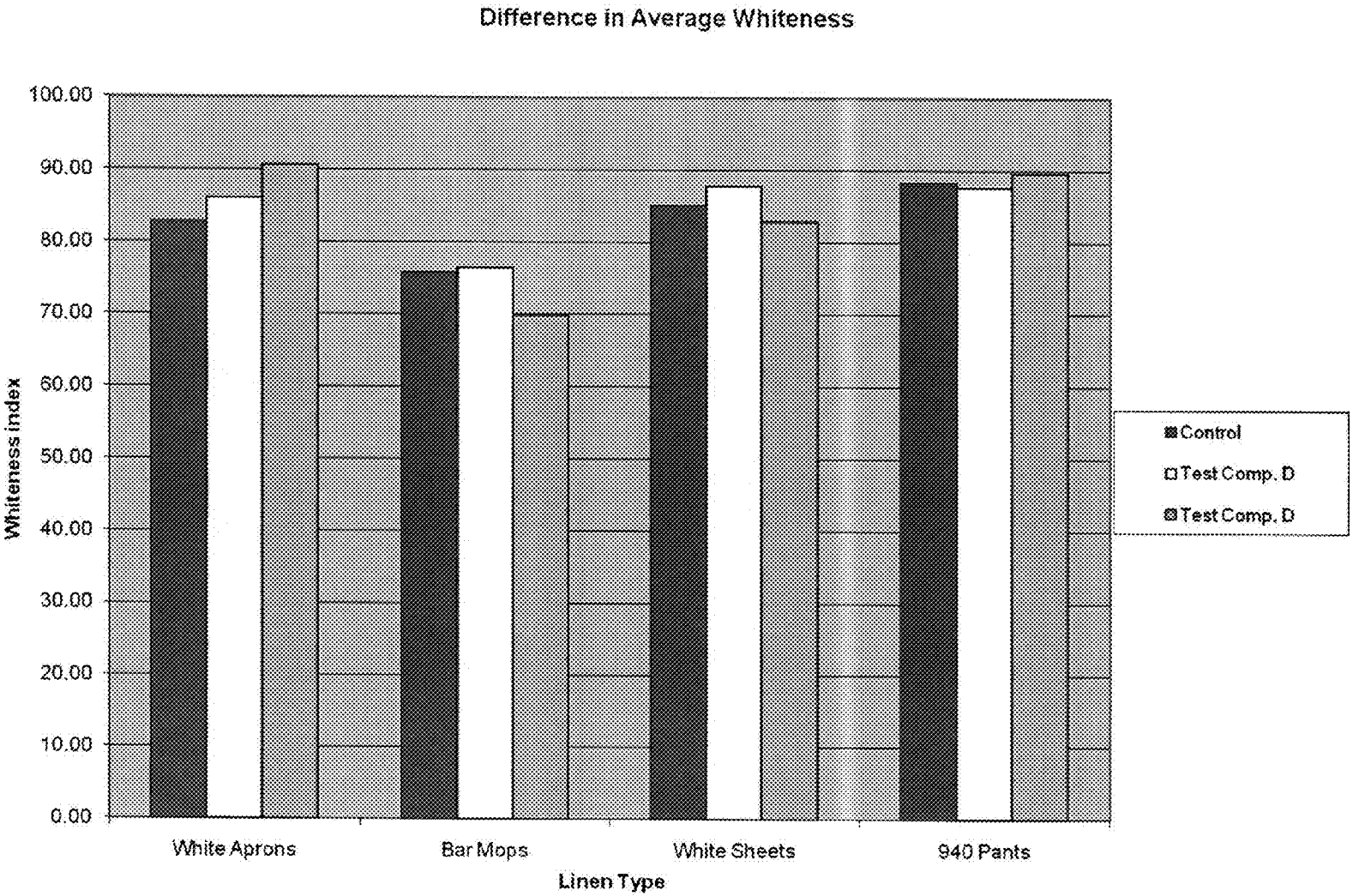
FIG. 4 is a graphical depiction of the difference in average whiteness of various materials after treatment with embodiments of the invention, or a commercially available detergent.

The whiteness evaluation was performed to gather information on the overall whiteness of the textiles in the plant, as well as to check for possible re-deposition of soil onto the garments. A Konica-Minolta 2600d handheld spectrophotometer was used for all whiteness measurement tests. Four different garment classifications were evaluated in this test: white aprons, white sheets, bar mops and pants. For each of these classifications, ten pieces of each were randomly chosen on day one and the whiteness was measured with the spectrophotometer. Then, during week one and again on week two, the same thing was done for each class of material. The results are shown in FIGS. 3 and 4. The L value shown in these figures specifically measures the white to black part of the color spectrum.

As can be seen from FIG. 3, there was no significant change in the L value between Test Composition D and the control detergent composition. Without wishing to be bound by any particular theory, it is thought that the lack of significant change on any classification indicates that the detergent is preventing soil re-deposition.

FIG. 4 shows the overall whiteness index for the fabrics tested. As can be seen in this figure, after week one, whiteness had improved or remained unchanged on all classifications. However, the two week results indicated that there was an increased whiteness on the aprons and pants, but a decreased whiteness on the white sheets and bar mops. This was thought to be due in part to the fact that whiteness tends to vary slightly. It was also noted that the L value did not change, indicating a problem in the other spectrums. It was also observed that there were significant iron deposits on the bar mops, which likely led to the decreased overall whiteness.

Sink Test

The sink test is designed to quickly evaluate the amount of oils on a shop towel. Ten towels of the same size and make were randomly selected from the finished side. The towels were folded in half and rolled into a tube shape. Each towel was then placed in a bucket of water, and the time taken for each to sink was recorded. This was done for baseline, at week one, and at week two. The averages are shown in the table below.

TABLE 6

| Detergent | Average Sink Time (seconds) |
|---|---|
| Control | 23.31 |
| Test Composition D (week 1) | 19.38 |
| Test Composition D (week 2) | 22.57 |

A time less than 30 seconds is considered acceptable by industry standards. As can be seen from the data above, the towel treated with Test Composition D had a much shorter sink time compared to the control towel in week one. Although the sink time increased for the towel treated with Test Composition D in week two, it was still shorter than the average sink time for the control towel. Overall, this test indicated that the industrial oil soil removal performance was substantially unchanged using a Test Composition in accordance with embodiments of the disclosure, compared to a control detergent.

Smoke and Haze

Smoke and haze was observed to immediately and significantly reduce once Test Composition D was used. This applied to all classifications that were problems originally, as well as on both flatwork irons and the steam tunnel.

Shaker Screen Blinding

There were no observed problems with the shaker screen when Test Composition D was used.

Overall, it was found that Test Composition D was effective at reducing smoking and hazing, while also achieving the necessary cleaning and whiteness.

Example 5

A study was run in an industrial laundry plant to evaluate the impact on smoking and/or hazing of the ratio of moles of anionic surfactant to moles of free alcohol in a detergent composition. Several detergent compositions were tested. The table below shows the different compositions tested, and the moles free alcohol and anionic surfactant in each composition. The table also shows whether there was smoking/hazing observed when textiles treated with the detergent compositions were heated. For this test, either the hot-plate method described above was used, or an in plant observation was made.

TABLE 7

| Test Composition | Nonionic Surfactant (wt %) | Free Alcohol (wt %) | Moles Free Alcohol | Anionic Surfactant (wt %) | Moles Anionic | Moles Anionic/ Moles Free Alcohol | Smoke/ Haze (yes/no) |
|---|---|---|---|---|---|---|---|
| Turbo Flex D[1] | 70 | 0.000 | 0.000 | 10 | 0.019 | N/A | No |
| TurboFlex D AE[2] | 71 | 7.215 | 0.036 | 3 | 0.006 | 0.16 | Yes |
| E-Max[3] | 77.33 | 5.542 | .027 | 7.84 | 0.005 | 0.20 | Yes |
| Text Composition E | 62 | 5.76 | 0.029 | 14.91 | 0.04 | 1.39 | Yes |
| Test Composition F | 46.1 | 1.842 | 0.009 | 18 | 0.043 | 4.59 | No |
| Test Composition G | 30 | 0.600 | 0.003 | 17.4 | 0.046 | 13.88 | No |

[1]Turbo Flex D, commercially available from Ecolab Inc. (includes NPEs as nonionic surfactants, but has no free alcohol).
[2]TurboFlex D AE, commercially available from Ecolab Inc. (contains free alcohol).
[3]E Max, commercially available from Dober Chemical Corp. (contains free alcohol).

As can be seen from the above table, it was found that a detergent composition with a ratio of greater than about 1.4 moles anionic/moles free alcohol does not result in smoking and/or hazing when garments treated with such a detergent are heated.

Test Composition G was also evaluated for the ability to remove soils from garments, while not smoking or hazing. For this test, the soil removal, and garment whiteness of garments treated with Test Composition G were measured. A sink/wick-up test (as described above) was also performed.

Figure 5:
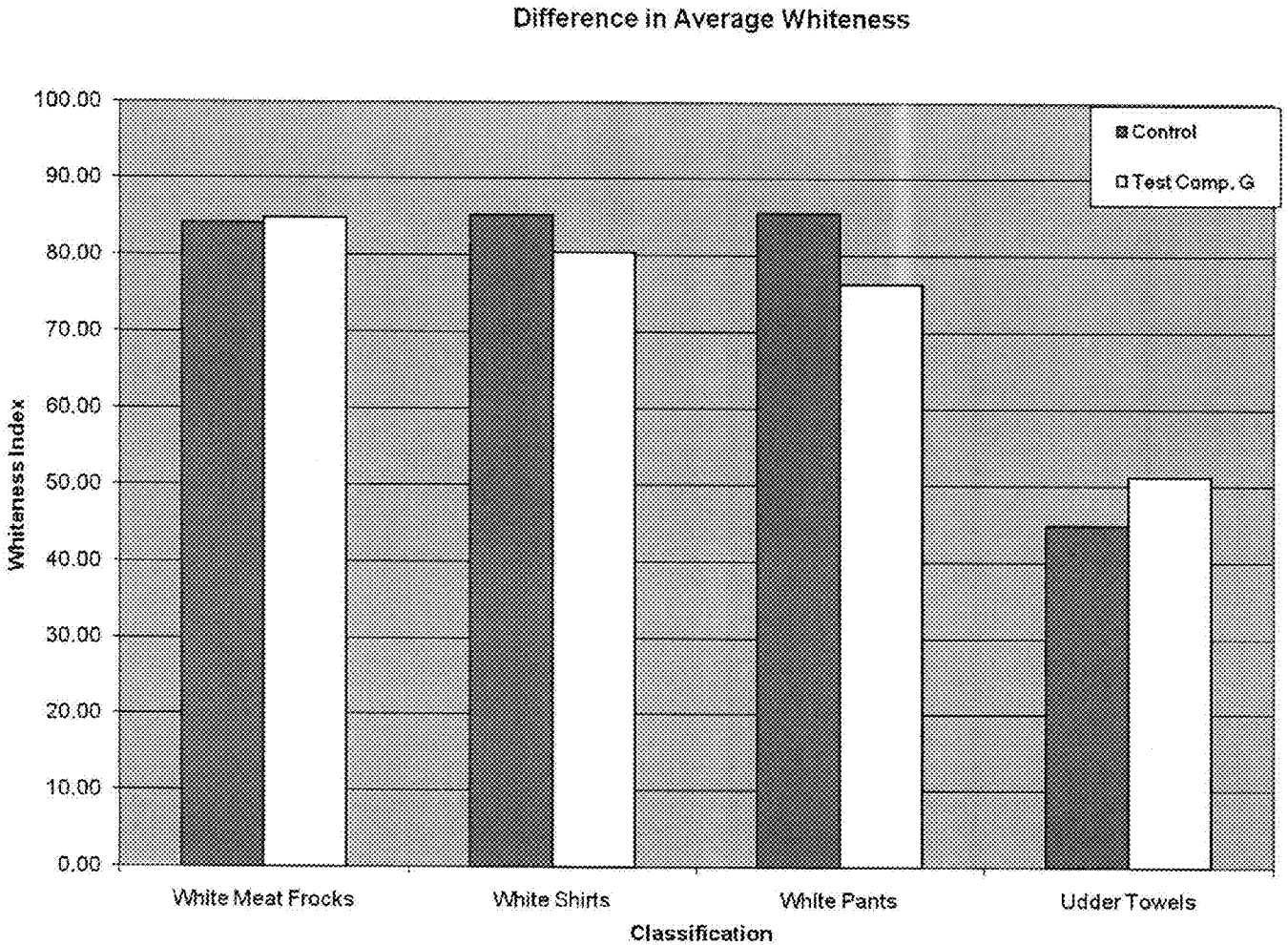
FIG. 5 is a graphical depiction of the difference in average whiteness of various materials after treatment with embodiments of the invention, or a commercially available detergent.

For the whiteness test, Test Composition G was compared to TurboFlex D a commercially available detergent available from Ecolab Inc. The results of the whiteness test are shown in FIG. 5. As can be seen from this figure, a small decrease was observed in the whiteness on white shirts and pants. However, there was an improved whiteness on udder towels, and substantially no change in meat frocks.

Figure 6A:
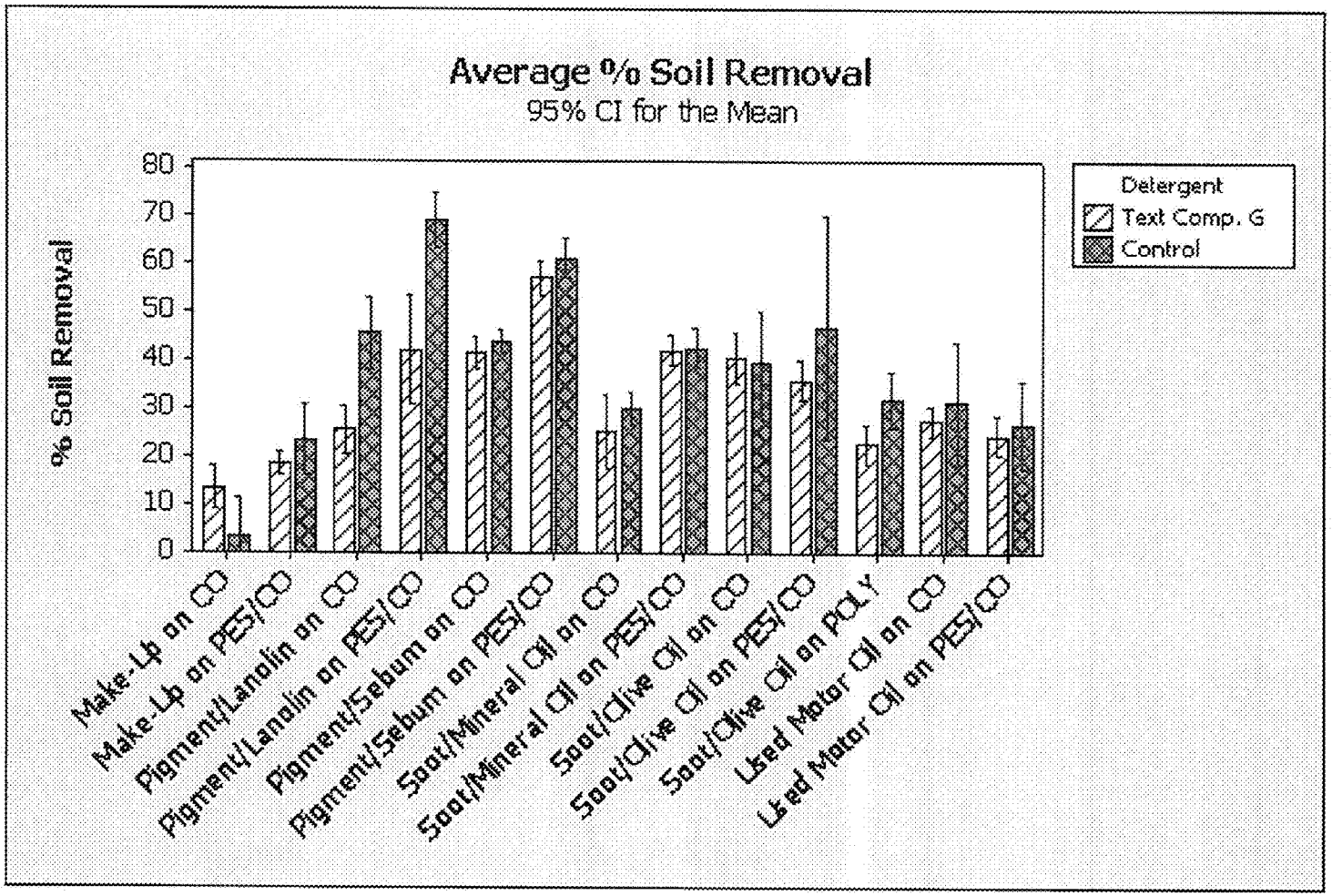
FIGS. 6*a*, 6*b*, and 6*c* are graphical depictions of the average percent soil removal on industrial pants (FIG. 6*a*), industrial shirts (FIG. 6B), and udder towels (FIG. 6*c*) after treatment with embodiments of the invention, or a commercially available detergent.
Figure 6B:
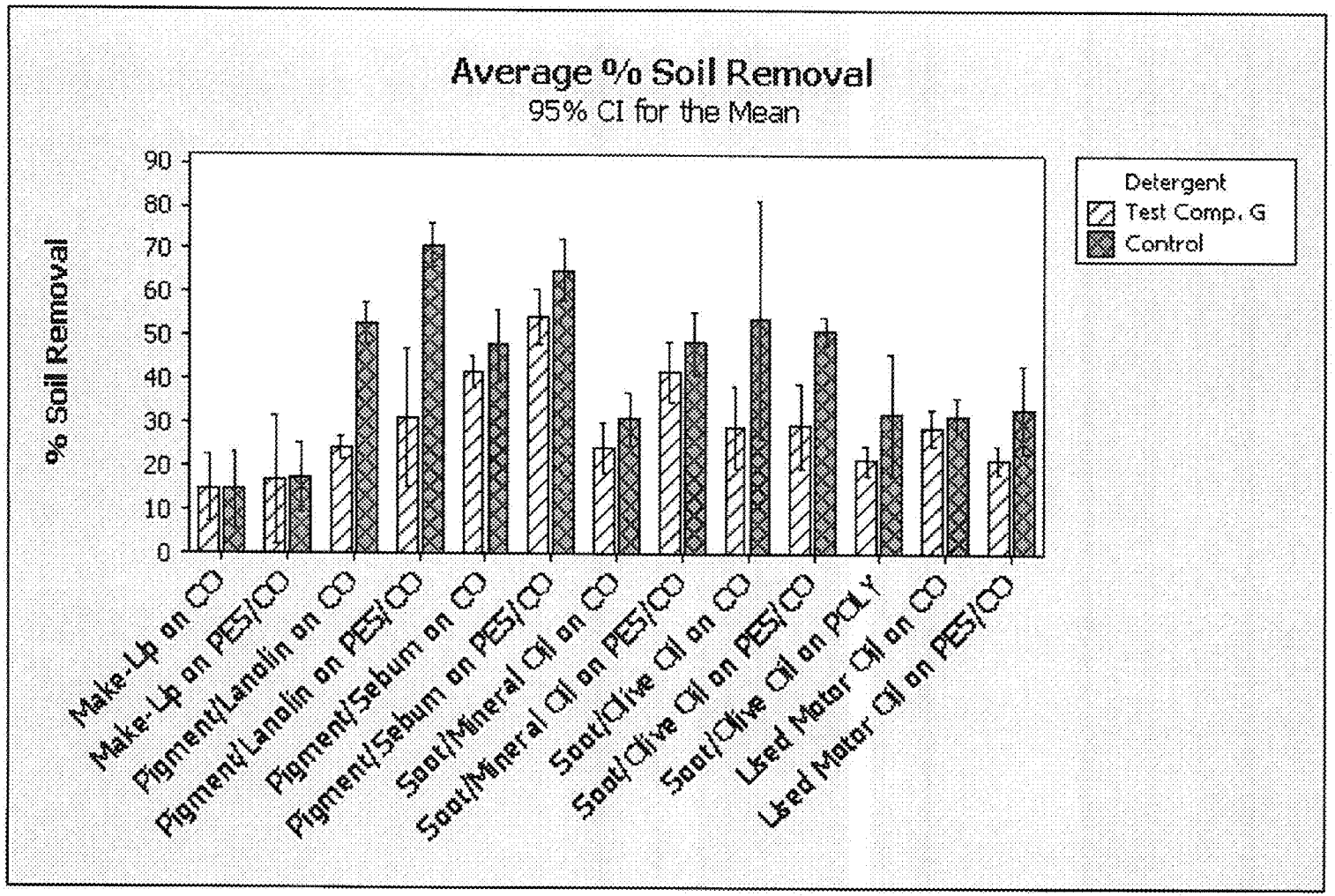
Figure 6C:
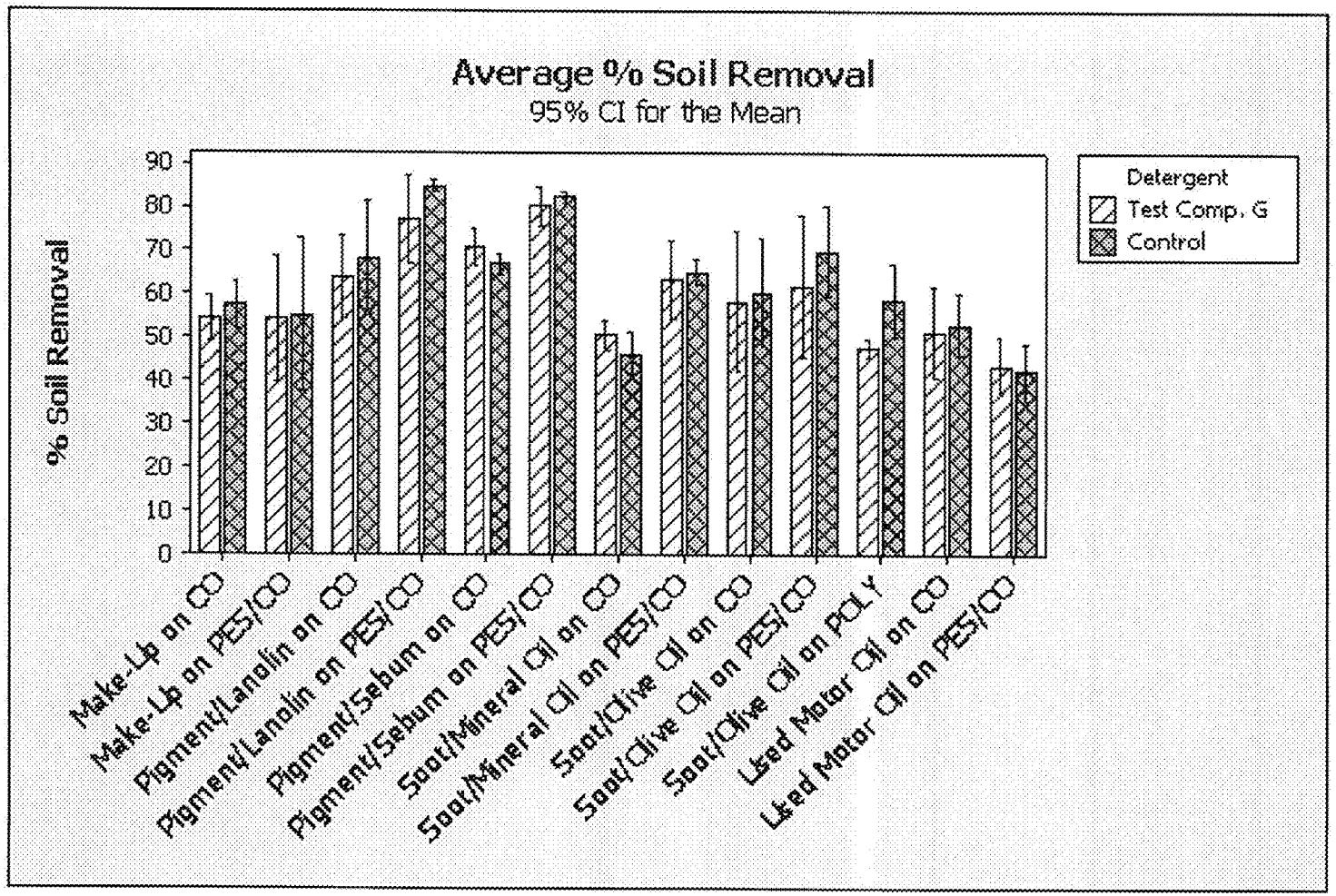

For the soil removal test, Test Composition G was compared to TurboFlex D, a commercially available detergent from Ecolab Inc. FIGS. 6*a*, 6*b*, and 6*c* shows the average percent soil removal on industrial pants (FIG. 6*a*), industrial shirts (FIG. 6B), and udder towels (FIG. 6*c*). As can be seen from these figures, there was no statistical difference between Test Composition G and TurboFlex D. With respect to the industrial shirts, there was a slightly lower average percent soil removal for the shirts washed with Test Composition G. As can be seen in FIG. 6*c*, there was no statistical difference in the average percent soil removal on the udder towels between the two detergents tested.

Overall, the data indicated that Test Composition G was performing equal when compared to TurboFlex D. Performance was acceptable, and the whiteness showed substantially no change.

Other Embodiments

It is to be understood that while the invention has been described in conjunction with the detailed description thereof, the foregoing description is intended to illustrate, and not limit the scope of the invention, which is defined by the scope of the appended claims. Other aspects, advantages, and modifications are within the scope of the following claims.

In addition, the contents of all patent publications discussed supra are incorporated in their entirety by this reference.

It is to be understood that wherever values and ranges are provided herein, e.g. weight percents, all values and ranges encompassed by these values and ranges, are meant to be encompassed within the scope of the present invention. Moreover, all values that fall within these ranges, as well as the upper or lower limits of a range of values, are also contemplated by the present application.

The invention claimed is:

1. A detergent composition comprising:

(a) a smoke reducing surfactant package comprising an anionic surfactant, and an amphoteric surfactant comprising a cocoamine oxide; and (b) a detersive surfactant comprising a nonionic surfactant having a smoke producing amount of free alcohol, the nonionic surfactant comprising an alcohol ethoxylate comprising a C8-C18 alcohol with 1-15 moles of ethylene oxide, wherein the alcohol ethoxylate is not a narrow range alcohol ethoxylate; and (c) water, wherein the detergent composition has a mole ratio of about 1.4 to about 1 of the smoke reducing surfactant package to moles free alcohol, and the detergent is free of phosphorous, and nonylphenol ethoxylates.

2. The detergent of claim 1 wherein the detergent comprises about 1 wt % to about 50 wt % of the anionic surfactant.

3. The detergent of claim 1, wherein the anionic surfactant is selected from the group consisting of alkyl aryl sulfonates, ether sulfates, carboxylates, isethionates, silicone containing surfactants, secondary alkane sulfonates, alkyl methyl ester sulfonates, alpha olefin sulfonates, alkyl ether sulfates, alkyl sulfates, alcohol sulfates, and mixtures thereof.

4. The detergent of claim 1, wherein the anionic surfactant comprises a linear alkyl benzene sulfonic acid or salts thereof.

5. The detergent of claim 4, wherein the linear alkyl benzene sulfonic acid comprises linear dodecyl benzyl sulfonic acid, or salts thereof.

6. The detergent of claim 1, comprising about 5 wt % to about 85 wt % of the nonionic surfactant.

7. The detergent of claim 1, wherein the detergent comprises about 5 wt % to about 15 wt % of the amphoteric surfactant.

8. The detergent of claim 1, further comprising a solvent selected from the group consisting of glycerine, glycols, sorbitol, polypropylene glycol, polyacetates, diamines, aliphatic glycol ethers, aryl glycol ethers, aralkyl glycol ethers, aliphatic benzyl alcohol, isopropyl alcohol, esters, and mixtures thereof.

9. The detergent of claim 1, further comprising an optional ingredient selected from the group consisting of viscosity modifiers, fragrances, dyes, pigments, builders, threshold inhibitors for hard water precipitation, solidification aids, bleaches, bleach activators, antimicrobials, pH buffers, processing aids, active fluorescent whitening ingredient, an antifoam agent, and mixtures thereof.

10. The detergent of claim 1, further comprising an additional surfactant.

11. The detergent of claim 10, wherein the additional surfactant comprises a cationic quaternary ammonium compound.

12. A method for reducing or eliminating the production of smoke from a surface of an article during a heated laundry process, the method comprising:

(a) washing the article with a detergent composition comprising:

(i) a smoke reducing surfactant package comprising an anionic surfactant, and an amphoteric surfactant comprising a cocoamine oxide; and (ii) a detersive surfactant comprising a nonionic surfactant having a smoke producing amount of free alcohol, the nonionic surfactant comprising an alcohol ethoxylate comprising a C8-C18 alcohol with 1-15 moles of ethylene oxide, wherein the alcohol ethoxylate is not a narrow range alcohol ethoxylate; and (iii) water, wherein the detergent composition has a mole ratio of about 1.4 to about 1 of the smoke reducing surfactant package to moles free alcohol, and the detergent is free of phosphorous, and nonylphenol ethoxylates; and (b) treating the washed article in a heated laundry process.

13. The method of claim 12, wherein the article comprises a textile.

14. The method of claim 13, wherein the textile comprises a material selected from the group consisting of polyester, cotton, and mixtures thereof.

15. The method of claim 14, wherein the textile comprises at least about 60% polyester.

16. The method of claim 12, wherein the heated laundry process comprises passing the article through a steam tunnel, ironing the article, or combinations thereof.

17. The method of claim 12, wherein the temperature of the surface of the article is at least about 270° F. during the heated laundry process.

18. The method of claim 12, wherein the detergent further comprises an optional ingredient selected from the group consisting of viscosity modifiers, fragrances, dyes, pigments, builders, threshold inhibitors for hard water precipitation, solidification aids, bleaches, bleach activators, antimicrobials, pH buffers, processing aids, active fluorescent whitening ingredient, an antifoaming agent and mixtures thereof.

19. The method of claim 12, wherein the article to be cleaned is an article in an industry selected from the group consisting of institutional hospitality, food service, and healthcare industries.

* * * * *